US008203410B2

(12) United States Patent
Sundstrom et al.

(10) Patent No.: US 8,203,410 B2
(45) Date of Patent: Jun. 19, 2012

(54) INDUCTOR ASSEMBLY

(75) Inventors: Lance L. Sundstrom, Pinellas Park, FL (US); Wiclyff T. Bonga, Tampa, FL (US); Michael James Gillespie, Seminole, FL (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 12/716,876

(22) Filed: Mar. 3, 2010

(65) Prior Publication Data

US 2011/0215891 A1 Sep. 8, 2011

(51) Int. Cl.
*H01F 27/02* (2006.01)
*H01F 27/28* (2006.01)

(52) U.S. Cl. ..... 336/92; 336/90; 336/229

(58) Field of Classification Search ..... 336/229, 336/96, 90

See application file for complete search history.

(56) References Cited

U.S. PATENT DOCUMENTS

| | | | | | |
|---|---|---|---|---|---|
| 3,162,829 | A | * | 12/1964 | Snelling et al. | 336/83 |
| 3,237,137 | A | | 2/1966 | Flaminio | |
| 3,246,272 | A | | 4/1966 | Wiley | |
| 3,430,174 | A | * | 2/1969 | Ishizawa et al. | 336/83 |
| 3,584,823 | A | | 6/1971 | Andrew et al. | |
| 4,543,554 | A | * | 9/1985 | Muellenheim et al. | 336/83 |
| 4,623,865 | A | | 11/1986 | Kiesel et al. | |
| 4,658,091 | A | | 4/1987 | McCarthy et al. | |
| 4,754,250 | A | | 6/1988 | Duin | |
| 4,800,357 | A | | 1/1989 | Nickels, Jr. et al. | |
| 5,034,854 | A | * | 7/1991 | Matsumura et al. | 361/744 |
| 5,140,706 | A | | 8/1992 | Maeda et al. | |
| 5,214,403 | A | * | 5/1993 | Bogaerts et al. | 336/84 C |
| 5,307,041 | A | | 4/1994 | Kato et al. | |
| 5,309,130 | A | | 5/1994 | Lint | |
| 5,455,741 | A | | 10/1995 | Wai et al. | |
| 5,656,985 | A | | 8/1997 | Lu et al. | |
| 5,929,735 | A | | 7/1999 | Heinrich | |
| 5,952,907 | A | | 9/1999 | McWilliams et al. | |
| 6,927,663 | B2 | | 8/2005 | Iverson et al. | |
| 7,126,343 | B1 | * | 10/2006 | Howes et al. | 324/446 |
| 7,768,370 | B2 | * | 8/2010 | Brown | 336/90 |
| 7,834,736 | B1 | * | 11/2010 | Johnson et al. | 336/229 |
| 2007/0139149 | A1 | * | 6/2007 | Arai | 336/90 |
| 2009/0065964 | A1 | * | 3/2009 | Lotfi et al. | 264/104 |
| 2009/0130530 | A1 | * | 5/2009 | Tanaka | 429/34 |
| 2010/0127810 | A1 | * | 5/2010 | Rippel | 336/61 |

FOREIGN PATENT DOCUMENTS

CA 2194830 A1 7/1998

* cited by examiner

*Primary Examiner* — Anh Mai
(74) *Attorney, Agent, or Firm* — Shumaker & Sieffert, P.A.

(57) ABSTRACT

An assembly includes a toroidal induction component, a potting cup, and potting material. The toroidal induction component includes a conductive winding, where at least ends of the conductive winding define a lead set of the toroidal induction component. The potting cup is configured to accept the toroidal induction component and its lead set. Techniques for forming the assembly are also described.

20 Claims, 5 Drawing Sheets

INDUCTOR ASSEMBLY

STATEMENT REGARDING FEDERALLY SPONSORED RESEARCH OR DEVELOPMENT

This invention was made with Government support under Contract Number 4089 awarded by Lockheed Martin. The Government has certain rights in this invention.

TECHNICAL FIELD

The disclosure relates to assemblies for mounting electronic circuit components on printed boards (PBs).

BACKGROUND

Electronic components can be mounted on a printed board for various applications. One type of electronic component is a toroidal inductor, which can include a torus-shaped magnetic core around which one or more electrically conductive wires are coiled, thereby defining conductive windings. Electric current passing through the windings generates magnetic fields that are substantially confined to the magnetic core of the toroidal induction component. In this way, the inductor stores energy in a magnetic field in its core.

SUMMARY

The disclosure is directed to an assembly that includes a toroidal induction component, a potting cup, and potting material. The toroidal induction component (also referred to as a toroidal inductor) includes an electrically conductive wire that is wound around a magnetic core. The ends of the electrically conductive wire define a lead set that is used to electrically connect the toroidal induction component to another electronic component or to a printed board. In this way, the toroidal induction component is self-leaded. The disclosure is also directed to techniques for forming an assembly that includes a self-leaded toroidal induction component and a potting cup.

In one aspect, the disclosure is directed to an assembly that includes a toroidal induction component, a potting cup, and a potting material within the potting cup. The toroidal induction component includes at least one conductive winding, where ends of the at least one conductive winding define a lead set comprising a first lead and a second lead, and a magnetic core. The potting cup defines at least one aperture set comprising at least a first aperture that is configured to receive the first lead and a second aperture that is configured to receive the second lead.

In another aspect, the disclosure is directed to a method that includes defining at least one aperture set in a potting cup, where the aperture set comprises a first aperture and a second aperture, and inserting a toroidal induction component into the potting cup, where the toroidal induction component comprises at least one conductive winding around a magnetic core and at least a first lead and a second lead defined by respective ends of the at least one conductive winding, and where inserting the toroidal induction component into the potting cup comprises inserting the first lead into the first aperture and the second lead into the second aperture. The method further includes introducing a potting material into the potting cup. For example, the potting cup can be partially or completely filled with the potting material.

In another aspect, the disclosure is directed to an assembly comprising a toroidal induction component that comprises at least one electrically conductive wire, at least one lead set defined by ends of the electrically conductive wire, and a potting cup configured to receive the toroidal induction component. Leads of the lead set each extend through an aperture defined by the potting cup.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
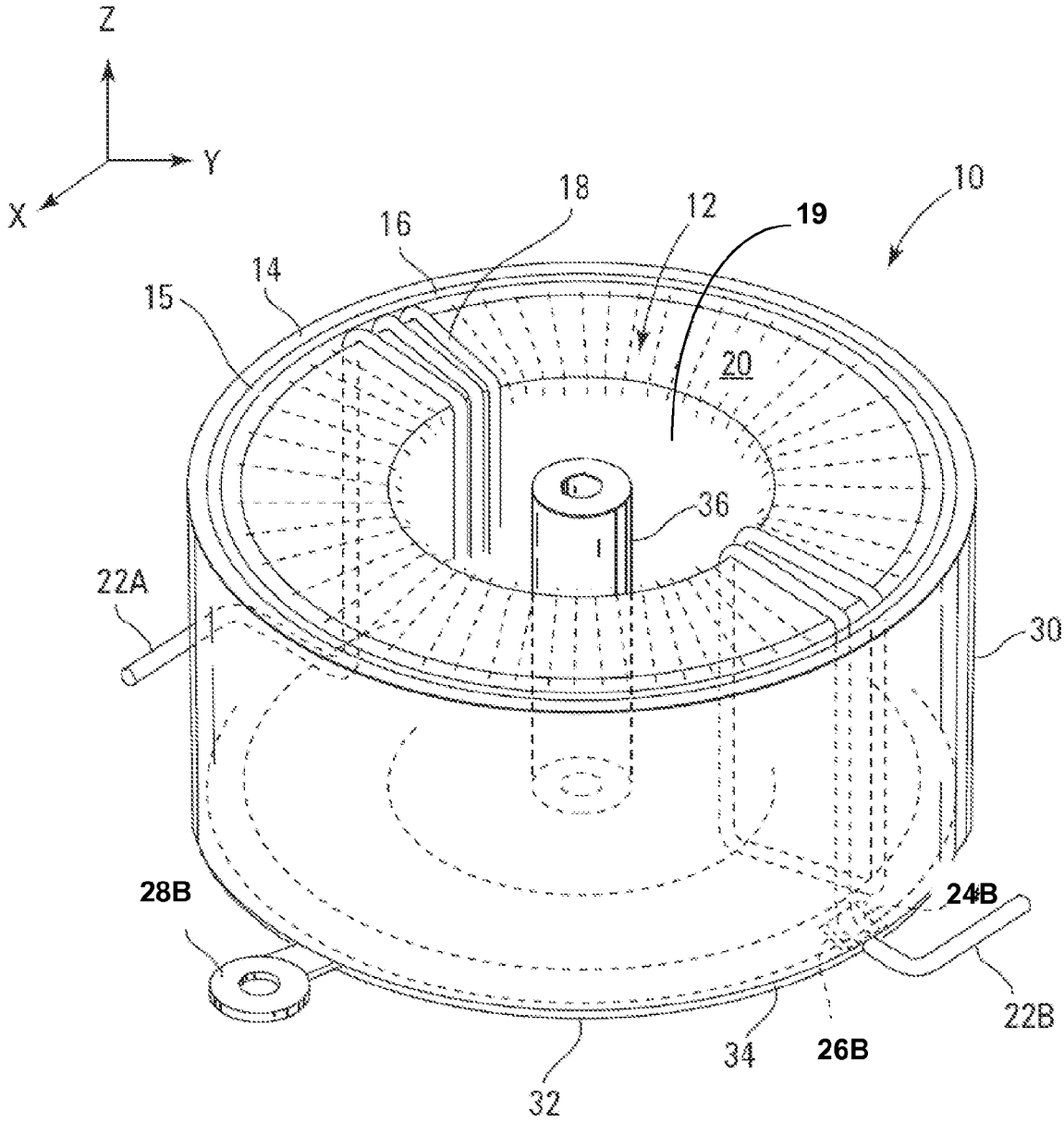
FIG. 1 is a schematic perspective view of an example assembly including a self-leaded toroidal inductor, a potting cup, and potting material.

A toroidal induction component (also referred to as a toroidal inductor) is an electronic component that temporarily stores energy in a magnetic field. The toroidal induction component includes a torus-shaped, e.g., doughnut-shaped, magnetic core, around which one or more electrically conductive wires are coiled, defining conductive windings. Electric current passing through the windings generates a magnetic field that is substantially confined to the magnetic core of the toroidal induction component. In this way, the toroidal inductor temporarily stores energy in a magnetic field.

The toroidal induction component can be electrically connected to a printed board via one or more electrically conductive leads. In conventional toroidal induction components, each lead is formed by splicing, e.g., by soldering, an insulated stranded wire to a mid-portion (e.g., the leads are center-tapped) or an end portion of a conductive winding. The splices are conventionally located on the top surface of the toroidal induction component, and the insulated stranded wire leads exit the periphery of the top surface of the toroidal induction component. The leads may be routed from the top periphery of the component, extending outside of the component, to a conductive surface pad or trace on the printed board (PB). In some examples, a relatively thin insulating standoff may be positioned between the printed board and the bottom surface of the toroidal induction component to prevent undesirable electrical connections (e.g., short circuits) between the winding and magnetic core of the component and the conductive surface traces and pads of the printed board.

In examples in which leads are spliced to the conductive winding of the toroidal induction component, relatively long lead lengths may be necessary to electrically couple the conductive winding to a printed board, e.g., to reach from the top surface or another surface of the component to the printed board. As the length of a lead increases, the resistance and inductance of the lead may also increase, which can decrease the amount of energy transferred from the toroidal induction component to the printed board. Additionally, if an insulating standoff is used, the insulating standoff may limit conduction of heat generated by the toroidal induction component to the printed board, which can result in a primary thermal conduction pathway through the leads of the toroidal induction component.

The assemblies described herein include a self-leaded toroidal induction component (also referred to herein as a toroidal inductor). The lead set that electrically couples the inductor to a printed board is defined by one or more conductive windings of the inductor. Electrically connecting a toroidal inductor to a printed board with a lead set that is defined by one or more conductive windings of the inductor can result in a more reliable electrical connection to the printed board compared to an assembly in which a lead separate from the conductive windings of the inductor is spliced to the conductive windings and coupled to the printed board. For example, the self-leaded toroidal induction component described herein has a fewer number of electrical connections between the induction component and the printed board compared to induction components that are coupled to a printed board via separate spliced leads. In examples of the assembly described herein, the assembly further includes a potting cup and potting material. As described in further detail below, the potting cup is configured to receive the toroidal induction component and defines apertures configured to accept the leads (e.g., defined by one or more lead sets) of the toroidal induction component. The potting cup and potting material may, in some examples, be formed from thermally conductive materials that help transfer heat generated by the toroidal induction component away from the toroidal induction component.

FIG. 1 illustrates a three-dimensional view of an example assembly 10. Assembly 10 includes a toroidal inductor 12, a potting cup 14, and potting material 16. Toroidal inductor 12 includes conductive winding 18 coiled around magnetic core 20. As illustrated in FIG. 1, magnetic core 20 has a torus shape, e.g., a doughnut-shape, and defines void 19 within its center. Conductive winding 18 is coiled at least one time through void 19 in magnetic core 20 and around the outer surface of magnetic core 20. Conductive winding 18 is coiled around magnetic core 20 such that the ends of conductive winding 18 are located at the periphery of the bottom surface of toroidal inductor 12. In FIG.1, the bottom surface of toroidal inductor 12 can be defined as the surface of toroidal inductor 12 having the smallest z-axis position (orthogonal x-y-z axes are shown in FIG. 1 for ease of description only). The ends of conductive winding 18 define a lead set that includes leads 22A and 22B (collectively "lead set 22"), which may be electrically coupled to a printed board (not shown in FIG.1) in order to form an electrical connection between toroidal inductor 12 and the printed board.

In the example illustrated in FIG. 1, conductive winding 18 is comprised of one continuous wire coiled around magnetic core 20 and terminating in lead set 22. In other examples, conductive winding 18 may be formed by more than one wire in series, where the multiple wires are coiled around magnetic core 20. This may be referred to as a tapped toroidal inductor 12. That is, a first wire may be coiled around magnetic core 20 to form a first portion of conductive winding 18. The ends of the first portion of conductive winding 18 may define a first lead set 22. A second wire may then be coiled around magnetic core 20 starting at the position where the first wire ended. The ends of the second wire may define a second lead set 22. Depending on the lengths of the wires and the size of the magnetic core, more than two wires may be used. In some examples, each of the individual leads 22 may be coupled to individual, e.g., separate, conductive pads on a printed board. In other examples, more than one lead 22 may be coupled to a common conductive pad on a printed board.

Potting cup 14 is configured to mount toroidal inductor 12 to a printed board. In some examples, toroidal inductor 12 has a relatively large mass, such that reliable mounting of toroidal inductor 12 to the printed wiring board may be difficult, e.g., because the mass of inductor 12 can compromise the integrity of the mechanical and electrical connections between inductor 12 and the printed board. Potting cup 14 can provide a relatively stable mechanical connection between toroidal inductor 12 and a printed board because, as described in further detail below, bottom surface 32 of potting cup 14 can be adhered to the printed board or one or more attachment elements (e.g., bolts or screws) can be used to mechanically couple potting cup 14 to the printed board.

Potting cup 14 defines cavity 15, which is configured to receive toroidal inductor 12. Potting cup 14 also defines an aperture set that includes apertures 24A (not shown in FIGS. 1) and 24B (collectively "aperture set 24") in which a grommet set that includes grommets 26A (not shown in FIGS. 1) and 26B (collectively "grommet set 26") is positioned. Although not shown in the figures, a lid can be positioned to substantially enclose cavity 15, such that toroidal inductor 12 is substantially enclosed by potting cup 14 and a lid (not shown). This may be useful for, for example, conducting heat away from toroidal inductor 12 in examples in which potting cup 14 and the lid are formed from a thermally conductive material. The lid may, but need not be, formed from the same material as potting cup 14. In addition, a top surface of the lid, e.g., the surface opposite bottom surface 32, can have any suitable contour (e.g., flat or rounded).

Toroidal inductor 12 is positioned within potting cup 14 and leads 22A, 22B extend through grommets 26A, 26B, respectively, such that leads 22A and 22B protrude out of potting cup 14. In the example shown in FIG. 1, potting material 16 substantially fills the space within potting cup 14 that is not occupied by toroidal inductor 12. Potting cup 14 also comprises mounting tabs 28A (not shown in FIG. 1) and 28B (collectively "mounting tabs 28") that may be mechanically coupled to a printed board to mechanically stabilize assembly 10 on the printed wiring board. Potting material 16 can help minimize the effects of shocks and vibrations on toroidal inductor 12 and may help prevent the intrusion of environmental contaminants (e.g., moisture or corrosive agents) from the cavity defined by potting cup 14.

Toroidal inductor 12 includes electrically conductive winding 18 and magnetic core 20. Conductive winding 18 and magnetic core 20 can be formed from any suitable materials. For example, conductive winding 18 may be formed from any material suitable for electrically conducting current around the outer surface of magnetic core 20, e.g., magnet wire. In some examples, conductive winding 18 may be formed from a metal such as copper (Cu), aluminum (Al), tin (Ti), gold (Au), and silver (Ag). Conductive winding 18 may, in other examples, be formed from an alloy comprising more than one type of electrically conductive metal. Similarly, magnetic core 20 can be formed from any type of material suitable for guiding magnetic fields within toroidal inductor 12. For example, magnetic core 20 may be formed from a material such as soft iron, laminated silicon steel, carbonyl iron, iron powder, or ferrite. Other materials for conductive winding 18 and magnetic core 20 are contemplated.

In some examples, magnetic core 20 and conductive winding 18 may be bonded together with a resin or another suitable material, e.g., via a vacuum impregnation process, such that the spaces between magnetic core 20 and conductive winding 18 are occupied by the resin. In some examples, an adhesive, e.g., an adhesive tape, may be applied around the perimeter of magnetic core 20 to hold conductive winding 18 tightly in place during the vacuum impregnation process. In examples in which magnetic core 20 is formed from a porous material, the sealing process may also fill the pores within magnetic core 20. In examples in which a resin is used to fill the spaces between magnetic core 20 and conductive winding 18, the resin may be a thermosetting material that can be cured and hardened to define a unitary structure that includes magnetic core 20 and conductive winding 18.

Figure 4:
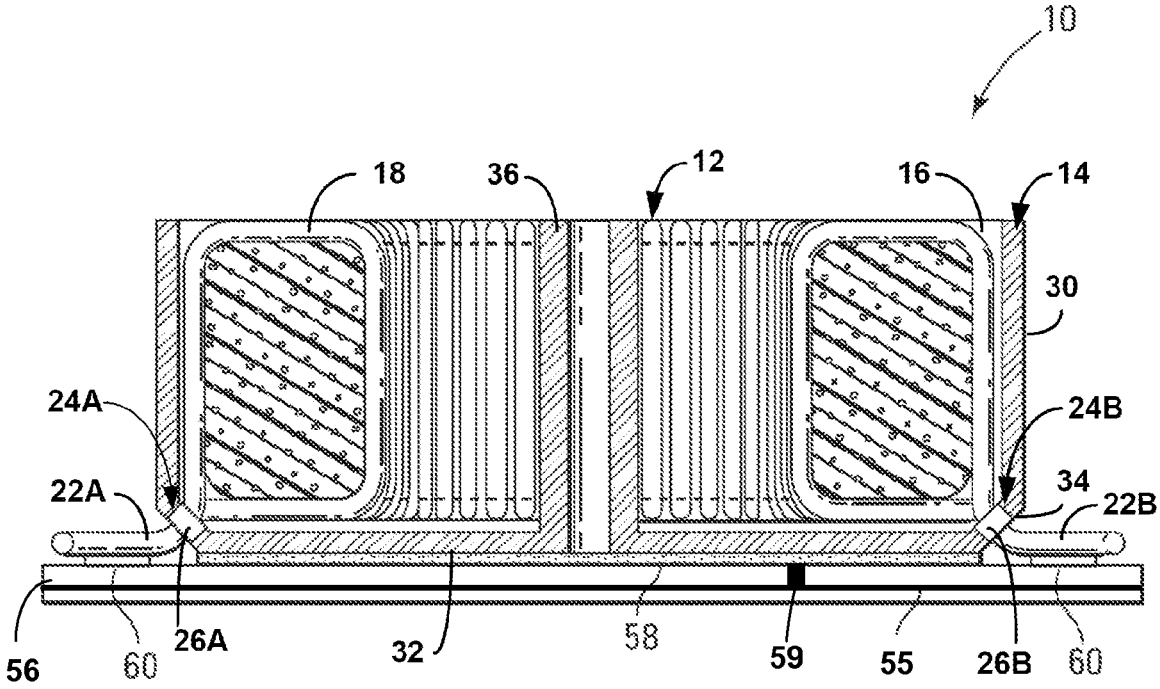
FIG. 4 is a schematic cross-sectional illustration of an example assembly mounted to a printed board. The example assembly includes a self-leaded toroidal inductor, a potting cup that includes a center portion, and potting material.

In some examples, lead set 22 defined by conductive winding 18 is configured for surface mount technology (SMT) attachment to a printed board. In SMT, an electrical component is electrically connected to a surface conductor of a printed board. In other examples, lead set 22 defined by conductive winding 18 is configured for through-hole attachment to a printed board, in which lead set 22 extends at least partially through an opening in the printed board. Lead set 22 may be electrically connected to a printed board using any suitable means. For example, lead set 22 may be soldered to surface conductive traces on a printed board in order to electrically connect toroidal inductor 12 to particular components of a printed board assembly (PBA). FIG. 4, which is described in further detail below, illustrates an example in which assembly 10 is mounted to a printed board.

FIG. 1 illustrates lead set 22 extending outward from the outer edge of potting cup 14. In the example illustrated in FIG. 1, leads 22A and 22B extend substantially perpendicularly outward from the perimeter of the bottom surface of potting cup 14 and bend to form an angle of approximately 90 degrees within the x-y plane. In some examples, conductive winding 18, magnetic core 20, potting cup 14, potting material 16, a printed board, and other components of a printed board assembly may be formed from materials with various coefficients of thermal expansion (CTEs). The differences in CTEs may cause various components of the printed board assembly to expand at various rates depending on environmental conditions, e.g., environmental temperature, which may cause relative motion between the components. The bent configuration of each of the leads 22A, 22B, illustrated in FIG. 1, provides a compliant shape that may allow lead set 22 to flex if relative motion occurs between components of a printed board assembly. The configuration may result in reduced stress and strain on the solder connections between lead set 22 and a printed board in comparison to a configuration in which lead set 22 is not bent.

Conductive winding 18 is coiled around magnetic core 20 such that the ends of conductive winding 18 define leads 22A and 22B, which terminate at the periphery of the bottom surface of toroidal inductor 12. In contrast to a configuration in which leads separate from the conductive winding of an inductor are spliced to the conductive winding at, e.g., a top surface of a toroidal induction component, and routed outside of the component to a printed board near the bottom surface of the component, a configuration that includes lead set 22 defined by the conductive winding 18 on the bottom surface of toroidal inductor 12 may minimize the length of the leads 22A and 22B that electrically couple inductor 12 to a printed board. Shorter lead lengths can minimize parasitic lead equivalent series inductance (ESL) and lead equivalent series resistance (ESR). Thus, the transfer of electrical energy, e.g., current, through the lead set 22 to the printed wiring board may be more efficient in comparison to a configuration that requires longer lead lengths. More efficient transfer of electrical energy and reduced parasitic lead losses may result in improved performance of the inductor assembly upon electrical coupling to a printed board.

Reducing the number of mechanical connection points between toroidal inductor 12 and the printed board can also improve mechanical integrity of the electrical assembly that includes toroidal inductor 12 and the printed board. Thus, compared to conventional assemblies in which a lead separate from the conductive windings of the inductor are used to electrically connect the inductor to the printed board, assembly 10 that includes self-leaded toroidal inductor 12 reduces the number of mechanical connection points. This can improve reliability of the system that includes a self-leaded inductor compared to a system that includes an inductor with spliced separate leads.

In conventional inductor assemblies that include a lead that is separate from the one or more conductive winding of a toroidal inductor, the splicing of the lead to the conductive winding can introduce inductor shape variation to the assembly. Thus, a batch of inductors can vary in shape. Eliminating the spliced lead from assembly 10 can help to provide a more uniform size of assembly 10.

Additionally, positioning of lead set 22 proximate to the printed board, e.g., near the periphery of the bottom surface of toroidal inductor 12, may simplify the process of coupling lead set 22 to the printed board, in contrast to a configuration in which the leads are routed from a top surface of a toroidal induction component down to the printed board. For example, the shorter lead length can help improve accessibility to the assembly 10 because there may be less congestion of elements on the printed board. That is, leads contribute to the congestion of components on a printed board. Minimizing the lead length by defining self-leaded inductor 12 can help minimize congestion. In this way, a printed board assembly including assembly 10 can be easier to inspect, as well as easier to assemble (e.g., by attaching other electrical components to the printed board) compared to printed board assemblies that include toroidal inductors that are electrically coupled to the printed board via relatively long leads that are separate from the inductor.

In addition, positioning of lead set 22 proximate to the printed board may reduce the complexity of the operation of attaching lead set 22 to a printed board. For example, attaching lead set 22 to a printed board may only require two hands, in comparison to example configurations that include spliced leads. As illustrated in FIG. 1, lead set 22 is pre-formed to be positioned proximate to the point of attachment, e.g., proximate to particular conductive surface traces or solder attachment pads on a printed board. Consequently, an operator may solder lead set 22 to a printed board by holding solder in his or her first hand and a soldering iron in his or her second hand. In contrast, a configuration that includes spliced leads may require an additional hand to hold and position the lead on the printed board.

The configuration illustrated in FIG. 1 may also require fewer components than configurations in which wires are spliced to a toroidal induction component and routed to a printed board, which may provide several advantages. For example, as illustrated in FIG. 1, conductive winding 18 defines lead set 22, and, consequently, assembly 10 does not require separate leads for electrical coupling to the printed board. The manufacturing process of assembly 10 may be simplified because the step of splicing separate leads to the toroidal induction component is eliminated. Additionally, the cost of an assembly such as assembly 10 may be lower because fewer components are required. Assembly 10 may also be more reliable because fewer electrical connections are required, e.g., assembly 10 requires only electrical coupling to a printed wiring board, in contrast to other configurations that may require both electrical coupling to a printed wiring board and splicing between the lead and the toroidal induction component.

Assembly 10 includes potting material 16 within potting cup 14. Potting material 16 is configured to substantially fill vacant space within the cavity of potting cup 14 after placement and positioning of toroidal inductor 12 within potting cup 14. For example, potting material 16 may fill space between toroidal inductor 12 and potting cup 14 and may fill space within void 19 of toroidal inductor 12 that is not occupied by center portion 36. In the example shown in FIG. 1, center portion 36 of potting cup 14 extends in a substantially positive z-axis direction from bottom surface 32 of potting cup 14. In some examples, center portion 36 is substantially integral with bottom surface 32, while in other examples, center portion 36 is separate from and mechanically attached to bottom surface 32. Center portion 36 defines a surface that can, but need not, contact toroidal inductor component 12 when component 12 is introduced into potting cup 14.

Potting material 14 may be any material suitable for substantially encapsulating toroidal inductor 12 within potting cup 14. For example, potting material 14 may comprise a thermosetting resin that can be poured into potting cup 14 in a low-viscosity form and cured, e.g., hardened, through the application of heat. Example thermosetting materials may include epoxy, urethane, silicone, acrylic, and polyester. .As another example, a two-part epoxy that includes a resin component and a catalyst component may be used. The two-part epoxy may be configured to harden upon mixing of the resin and catalyst components. Other types of potting material can also be used.

In some examples, thermal management of assembly 10 can be useful. For example, toroidal inductor 12 may generate heat upon delivery of current through conductive winding 18. Potting cup 14 and potting material 16 may provide a thermally conductive pathway through which heat generated by toroidal inductor 12 can be conducted away from toroidal inductor 12 in order to maintain the integrity and performance of toroidal inductor 12, e.g., by helping to mitigate disfiguration caused by overheating of toroidal inductor 12. In these examples, potting material 14 can comprise an electrically nonconductive, thermally conductive material. Potting material 16 may be electrically nonconductive in order to prevent undesirable electrical contact between conductive winding 18 or lead set 22 and a metal potting cup 14 or other electronic components or conductive traces on a printed wiring board.

In order to facilitate thermal management of assembly 10, potting material 14 and/or potting cup 16 may be formed from one or more materials with particular thermal properties. For example, the materials that form potting material 14 may be selected to have a particular thermal conductivity value, e.g., between approximately 0.4 Watts/meter/Kelvin (e.g., 30211/40008 Urethane Potting System made commercially available by EFI Polymers of Denver, Colo.) and approximately 1.2 Watts/meter/Kelvin (e.g., PC400 RAM system made commercially available by Campbell Scientific, Inc. of Logan, Utah). Additionally or alternatively, potting material 14 may be formed from a material with a particular coefficient of thermal expansion (CTE), e.g., between approximately 28 parts-per-million/degree Celsius (e.g., 20271/50013 Electrical Potting System made commercially available by EFI Polymers of Denver, Colo.) and approximately 80 parts-per-million/degree Celsius (e.g., PC400 system).

Potting cup 16 may also be formed from a material with particular thermal properties. In some examples, potting cup 16 may be formed from a material with a particular thermal conductivity, e.g., between approximately 0.2 Watts/meter/Kelvin (e.g., polyethylene terephthalate) and approximately 385 Watts/meter/Kelvin (e.g., copper). Potting cup 16 may, in some examples, be formed from a material with a particular CTE, e.g., between approximately 10 parts-per-million/degree Celsius (e.g., steel) and approximately 92 parts-per-million/degree Celsius (e.g., polyethylene terephthalate).

Heat generated by conductive winding 18 of toroidal inductor 12 may be transferred (conducted) through potting material 16 and potting cup 14 to the outer surface of potting cup 14. In this way, potting cup 14 and potting material 16 can help conduct heat away from the sides and bottom of inductor 12. The heat transferred to potting cup 14 can then be dissipated into surrounding air. For example, side surface 30 of potting cup 14 may, in some examples, dissipate heat generated by toroidal inductor 12 into surrounding air. In some examples, such as the example illustrated in FIG. 4, potting cup 14 may be thermally connected to a thermal core heat-sink layer of a printed board, e.g., by a thermally conductive via thermally connected to potting cup 14. For example, the printed board can include a thermally conductive trace that is thermally coupled to potting cup 14 and to a heat-sink layer of the printed board. As an example, in the example illustrated in FIG. 4, printed board 56 includes thermally conductive via 59 and heat-sink layer 55. Thermally conductive via 59 defines a thermally conductive pathway from potting cup 14 to heat-sink layer 55. In this way, potting material 16 and potting cup 14 may help transfer heat generated by toroidal inductor 12 to a heat-sink layer of the printed board. The thermally conductive trace can be the same as or different than an electrically conductive trace of the printed board.

Additionally or alternatively, potting cup 14 can be mounted to a printed wiring board via an electrically nonconductive, thermally conductive adhesive, which can facilitate dissipation of heat over a relatively large surface area of the printed board. A configuration that includes thermally conductive potting cup 14 and thermally conductive potting material 16 may provide improved thermal performance of assembly 10, e.g., may help prevent changes to the integrity of assembly 10 caused by overheating of toroidal inductor 12, in comparison to a configuration in which the leads of a toroidal induction component provide the only pathway for dissipation of heat generated by the toroidal induction component.

In other examples, such as in applications in which a relatively small amount of energy, e.g., current, is delivered through conductive winding 18, toroidal inductor 12 may generate no heat or a relatively small amount of heat. In these examples, potting material 16 and potting cup 14 need not be thermally conductive.

Potting cup 14 defines side surface 30, bottom surface 32, and interface portion 34, and includes center portion 36 and mounting tabs 28. In the example shown in FIG. 1, bottom surface 32 defines a substantially planar, substantially circular surface and side surface 34 defines a substantially cylindrical wall structure that extends in the positive z-axis direction from the plane of bottom surface 32. Interface portion 34 extends partially outward from and partially in the positive z-axis direction from the perimeter of bottom surface 32 to form an angled surface between bottom surface 32 and side surface 30. In this example, the circumference of side surface 30 may be slightly larger than the circumference of bottom surface 32 in order to accommodate interface 34 between side surface 30 and bottom surface 32.

Potting cup 14 may be made from any suitable material. In some examples, potting cup 14 may be formed from a thermally conductive material, e.g., a metal such as Aluminum (Al), copper (Cu), or a lightweight metal alloy. As described above, a thermally conductive material can help dissipate heat generated by toroidal inductor 12 when toroidal inductor 12 is disposed inside of potting cup 14. In other examples in which thermal management is not required, potting cup 14 may be formed from a material that is not thermally conductive, e.g., a molded plastic. Alternatively, side surface 30, bottom surface 32, and interface 34 may be formed from different materials. For example, bottom surface 32 may be formed from a thermally conductive material while side surface 30 and interface 34 need not be formed from a thermally conductive material. In this way, the direction of the conduction of heat away from potting cup 14 can be controlled.

In the example illustrated in FIG. 1, interface surface 34 of potting cup 14 defines aperture set 24. Apertures 24A, 24B each comprise vacant spaces within the outer wall of potting cup 14 that are configured to receive lead set 22. In some examples, grommet set 26 can be positioned within aperture set 24. In the example shown in FIG. 1, apertures 24A, 24B are each defined by cylindrical spaces in order to accept a respective grommet 26A, 26B that is configured to accept a respective lead 22A, 22B. In other examples, aperture set 24 can have other configurations, e.g., rectangular spaces.

Apertures of aperture set 24 may be formed in interface surface 34 of potting cup 14 using any suitable technique. In one example, apertures 24A, 24B are each defined by selectively removing knock-outs from various locations around the circumference of potting cup 14 within interface 34. Knock-outs may be predefined portions of potting cup 14 (e.g., interface surface 34 of potting cup 14) that are more easily removed from potting cup 14 than other portions of potting cup 14. For example, knock-outs can be defined by frangible seams within potting cup 14. The knock-outs can be prepositioned in potting cup 14 to accommodate various lead positions. By defining a plurality of knock-outs that can be selected during assembly of assembly 10, potting cup 14 can be configured to accommodate a plurality of lead positions. In this way, potting cup 14 and assembly 10 can be used with a plurality of different types of toroidal induction components and printed boards, which can have different configurations of electrically conductive traces to which lead set 22 is electrically coupled. At least some of the knock-outs defined by potting cup 14 can be removed in order to accommodate various lead configurations and the remaining knock-outs may be maintained within potting cup 14. Alternatively, potting cup 14 may include only the number and location of knock-outs needed to accommodate a particular lead configuration. In other examples, aperture set 24 may be formed using another technique, e.g., by drilling through interface 34.

In the example shown in FIG. 1, apertures 24A, 24B of assembly 10 are each configured to accept a respective grommet 26A, 26B. Grommets 26A, 26B of grommet set 26 are positioned within apertures 24A, 24B, respectively, in order to seal the area around leads 22A, 22B, respectively, upon positioning of toroidal inductor 12 within potting cup 14. Grommet set 26 can be configured to help prevent moisture and corrosive agents from penetrating into potting cup 14 through aperture set 24, as well as prevent potting material 16 from leaking out of potting cup 14 before potting material 16 has been cured, e.g., hardened. As illustrated in FIG. 1, grommets 26A, 26B each have a cylindrical configuration in order to form a tight fit within the respective aperture 24A, 24B. In other examples in which apertures 24A, 24B have a configuration other than cylindrical, grommets 26A, 26B may also have a different, corresponding configuration. In addition, in some examples, grommets 26 are not used with potting cup 14.

Grommets 26A, 26B may be formed from any material suitable for providing a seal between lead set 22 and aperture set 24. For example, grommets 26A, 26B may be formed from rubber, plastic or another compressible material. In some examples in which potting cup 14 is made of a conductive material, grommet set 26 may be formed from an electrically and/or thermally insulating material in order to insulate lead set 22 from potting cup 14.

Potting cup 14 may be formed from one or more pieces. For example, in some examples, potting cup 14 may be a one-piece structure. Potting cup 14 may be formed, e.g., molded, to include any of the features illustrated in FIG. 1 in a single structure. In examples in which potting cup 14 is a one-piece structure, potting cup 14 can be molded or otherwise defined to include any of side surface 30, bottom surface 32, interface surface 34, center portion 36, and mounting tabs 28. In these examples, aperture set 24 may be formed by, e.g., selectively removing knockouts within interface 34.

In other examples, potting cup 14 may not include interface surface 34. Instead, potting cup 14 may be formed such that side surface 30 extends substantially vertically in the z-axis direction directly from bottom surface 32, e.g., side surface 30 and bottom surface 32 may have substantially the same circumference and directly contact each other. Aperture set 24 may, in these examples, be defined by a portion of either side surface 30 or bottom surface 32. For example, in examples in which apertures 24A, 24B are defined by bottom surface 32, apertures 24A, 24B may be defined by cylindrical spaces that extend through bottom surface 32 in a substantially vertical direction, e.g., in a direction substantially in line with the z-axis. In other examples, apertures 24A, 24B may be defined by portions of both side surface 30 and bottom surface 32.

In other examples, potting cup 14 can include two or more pieces that are mechanically coupled together. For example, bottom surface 32, mounting tabs 28, and center portion 36 may be molded as a first piece and side surface 30 may be molded as a second piece. The first piece may include a first portion of interface 34 extending upwards, e.g., partially in the positive z-axis direction, from bottom surface 32 and the second piece may include a second portion of interface 34 extending downwards, e.g., partially in the negative z-axis direction, from side surface 30. In this example, both the first and second pieces may include knockouts in interface surface 34 that may be selectively removed to define apertures 24. For example, both the first and second pieces may include knockouts that, when positioned proximate to one another, define a cylindrical apertures 24A, 24B, e.g., the knockouts each define half-cylinders.

The plurality of pieces that define potting cup 14 can be mechanically coupled together using any suitable technique. In one example, the two or more pieces of potting cup 14 are snap fit together, e.g., at the intersection of the interface surface 34 portion of a first structure and the interface surface 34 portion of a second structure, in order to create a seal between the first and second structures. In another example, the two or more pieces of potting cup 14 are welded (e.g., ultrasonically welded) or adhered together. Other mechanical coupling techniques are also contemplated.

Potting cup 14 may also be a multi-piece structure that does not include interface 34. For example, side surface 30 and bottom surface 32 may be mechanically coupled, e.g., via a snapping mechanism, around a bottom perimeter in order to form potting cup 14. As described previously, in examples in which potting cup 14 does not include interface 34, aperture set 24 may be defined by either side surface 30 or bottom surface 32.

In the example illustrated in FIG. 1, potting cup 14 includes center portion 36, which extends in the positive z-axis direction from substantially the center of bottom surface 32. Center portion 36 extends through void 19 in the center of toroidal inductor 12 upon positioning of toroidal inductor 12 within potting cup 14, as illustrated in FIG. 1. Center portion 36 can help align inductor 12 within potting cup 14. Center portion 36 may be formed from the same material as side surface 30, bottom surface 32, and interface 34 or, in other examples, may be formed from a different material. Although FIG. 1 illustrates center portion 36 extending substantially entirely through toroidal inductor 12 in the z-axis direction, in other examples center portion 36 may extend only partially through toroidal inductor 12.

Center portion 36 may be a substantially cylindrical extension of bottom surface 32 that, in examples in which thermal management is required, is formed from a thermally conductive material, e.g., a metal, and is configured to dissipate heat generated by toroidal inductor 12 through bottom surface 32. Alternatively or additionally, center portion 36 may be a substantially cylindrical extension of bottom surface 32 that defines a hollow center configured to accept a bolt or other mounting mechanism used in mounting assembly 10 to a printed wiring board. In some examples, center portion 36 may increase the mechanical stability of assembly 10 by limiting movement of toroidal inductor 12 within potting cup 14.

Figure 3:
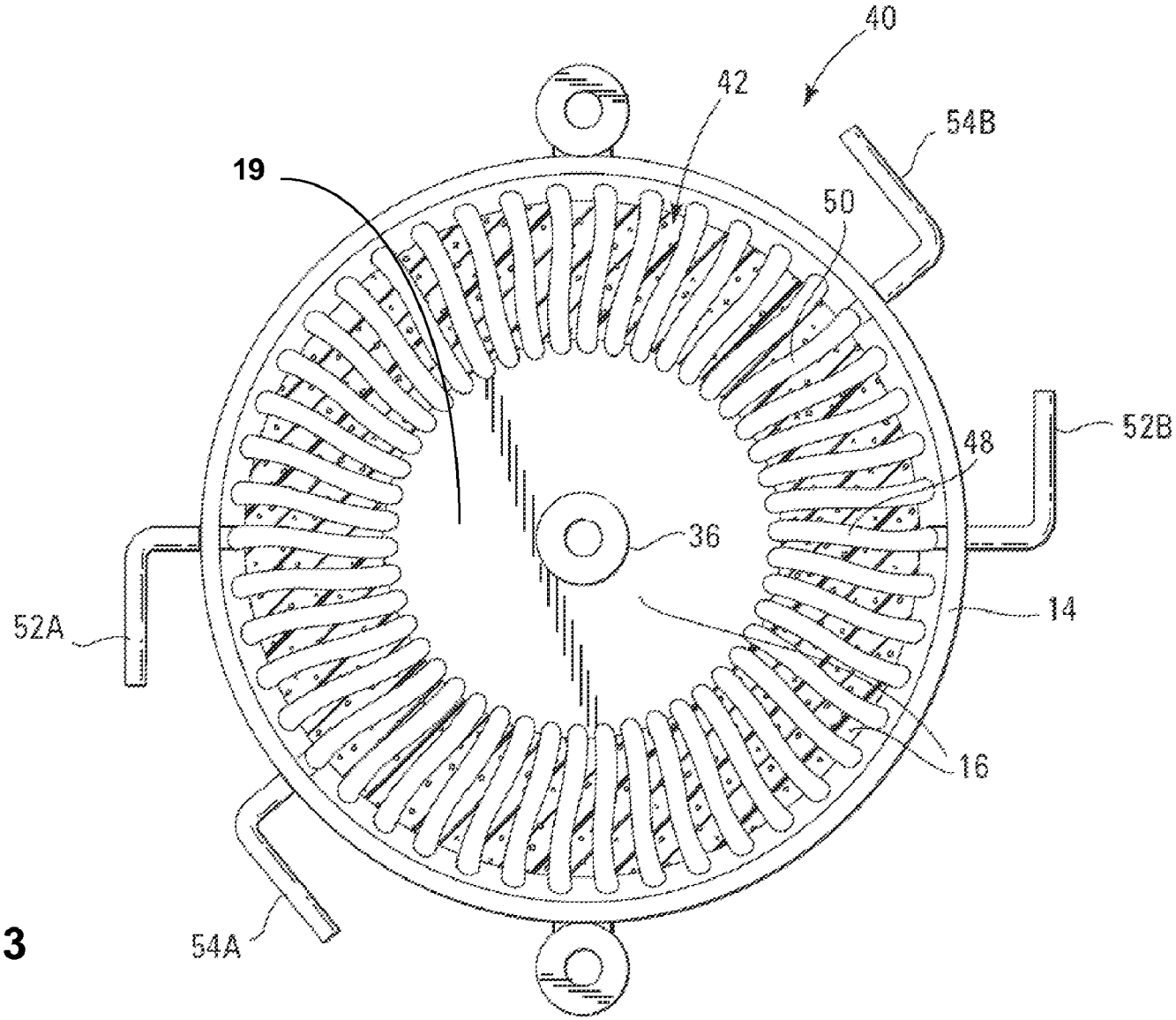
FIG. 3 is a schematic top view of an example assembly including a self-leaded toroidal transformer with two conductive windings and two lead sets, a potting cup, and potting material.

In some examples, potting cup 14 may not include center portion 36. In these examples, potting cup 14 may include another extension, e.g., a threaded insert configured to accept a bolt to facilitate mounting of assembly 10 to a printed board, as illustrated in FIG. 3 and described below. Alternatively, potting cup 14 may not include any extension.

FIG. 1 also illustrates mounting tabs 28 of potting cup 14. In some examples, mounting tabs 28 are positioned in approximately the same plane as bottom surface 32. In some examples, mounting tabs 28 extend from side surface 30 or bottom surface 32 of potting cup 14 and are integral with potting cup 14. In other examples, mounting tabs 28 are mechanically coupled to a portion of potting cup 14. Mounting tabs 28 may be formed from the same material as potting cup 14 or may be formed from a different material. For example, mounting tabs 28 may be formed from a thermally conductive material that may dissipate heat generated by toroidal inductor 12, in examples in which thermal management is desired. In other examples, mounting tabs 28 may be formed from a material that is not thermally conductive.

Mounting tabs 28 provide a mechanism for mechanically coupling assembly 10 to a printed board. In some examples, mounting tabs 28 are configured to be soldered to a printed board, e.g., mounting tabs 28 may form a solder tab. Alternatively or additionally, mounting tabs 28 may include an aperture that is configured to accept an attachment member. For example, mounting tabs 28 can be configured to accept a screw or bolt, e.g., mounting tabs 28 may define a threaded aperture. In some examples, mounting tabs 28 can be eyelets that are capable both of being soldered to a printed board and accepting an attachment member. In examples in which mounting tabs 28 are configured to accept an attachment member, mounting tabs 28 may be thicker, e.g., may have a greater dimension in the z-axis direction compared that shown in the example illustrated in FIG. 1.

Two mounting tabs 28, as illustrated in FIG. 1, are positioned on substantially opposite sides of potting cup 14 around the perimeter of bottom surface 32. In other examples, potting cup 14 may include only one mounting tab 28 or may include more than two mounting tabs 28, positioned at any suitable location around the perimeter of bottom surface 32.

Although FIG. 1 illustrates potting cup 14 as a substantially cylindrical object, in other examples, potting cup 14 may have a different configuration. For example, side surface 30, bottom surface 32, and interface 34 may not be substantially circular or cylindrical. Side surface 30, bottom surface 32, and interface 34 may instead form, e.g., a box-like structure, in which side surface 30 and bottom surface 32 may be of substantially square or rectangular form. Additionally, assembly 10 may, in some examples, include a lid that may cover toroidal inductor 12, creating a housing within potting cup 14 for toroidal inductor 12.

As illustrated in FIG. 1, assembly 10 includes toroidal inductor 12, which includes one conductive winding 18. In other examples, assembly 10 may include a toroidal induction component with more than one conductive winding 18 and, consequently, more than one lead set 22, e.g., a toroidal transformer. In these examples, potting cup 14 defines more than one aperture set 24 to accommodate more than one lead set 22. An assembly including a toroidal transformer is illustrated in FIG. 3, which is described below.

Figure 2:
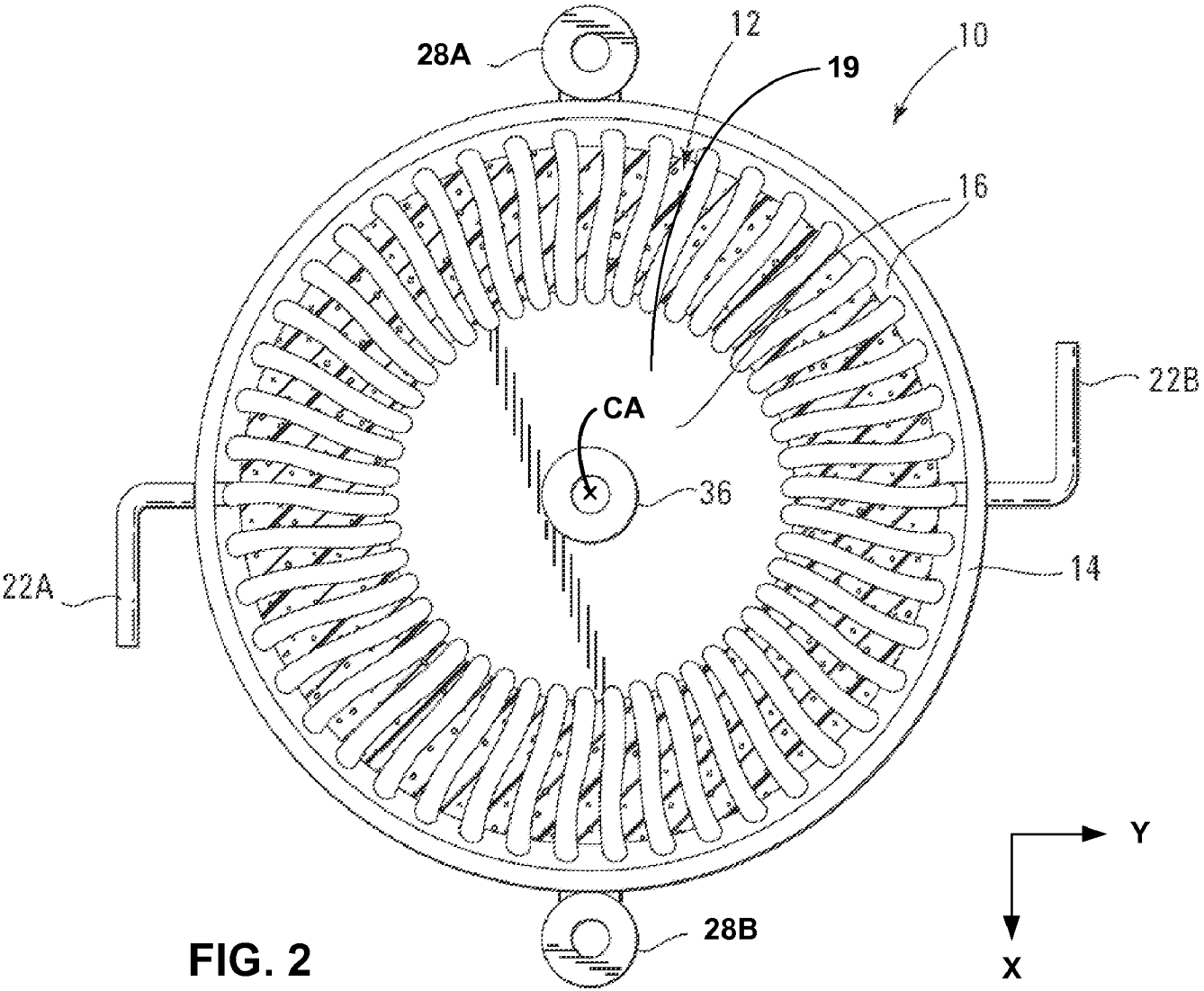
FIG. 2 is a schematic top view of an example assembly including a self-leaded toroidal inductor with one conductive winding and one lead set, a potting cup, and potting material.

FIG. 2 illustrates a schematic top view of assembly 10, including toroidal inductor 12, potting cup 14, and potting material 16. Toroidal inductor 12 is positioned within potting cup 14, which is filled with potting material 16. In the example illustrated in FIGS. 1 and 2, leads 22A, 22B are each inserted into and extend through a respective grommet 26A, 26B, which are each positioned within a respective aperture 24A, 24B defined by potting cup 14. That is, conductive winding 18 defines lead set 22 that extends through aperture set 24 and provide an electrical connection to toroidal inductor 12 from an exterior surface of potting cup 12.

FIG. 2 illustrates the configuration of lead set 22 upon exiting potting cup 14. In the example shown in FIG. 2, leads 22A and 22B extend from substantially opposite (e.g., 180 degrees apart) surfaces of potting cup 14. In addition, lead set 22 is defined to extend radially outward from a center of magnetic core 20, e.g., extend substantially perpendicularly outward from the outer perimeter of potting cup 14. In the example shown in FIG. 2, lead 22A extends partially in the negative y-axis direction and partially in the positive x-axis direction from the perimeter of potting cup 14 and lead 22B extends partially in the positive y-axis direction and partially in the negative x-axis direction from the perimeter of potting cup 14 (orthogonal x and y axes are shown for the purpose of aiding the description only). Lead set 22 is arranged such that leads 22A and 22B each extend in a common radial direction around an outer perimeter of potting cup 14. The arrangement of lead set 22 from potting cup 14 shown in FIG. 2 helps reduce a footprint of assembly 10 compared to examples in which lead set 22 extends outward from potting cup 14 without pivoting in another direction. Reducing a footprint of assembly 10 can be useful for reducing congestion on a printed board when multiple components are placed on a common printed wiring board.

In other examples, lead set 22 may extend outward from different positions around the perimeter of potting cup 14 and at different angles relative to potting cup 14. For example, lead set 22 need not extend from substantially opposite positions around the perimeter of potting cup 14. Instead, leads 22A and 22B may extend from positions on substantially the same side of the outer perimeter of potting cup 14 (e.g., separated by less than 180 degrees when potting cup 14 has a substantially circular outer perimeter). Additionally, lead set 22 may extend outward from potting cup 14 at an angle that is not substantially perpendicular to the perimeter of potting cup 14, e.g., lead set 22 may extend at an angle of forty-five degrees. In other examples, lead set 22 is arranged such that leads 22A and 22B each extend in a different radial direction around an outer perimeter of potting cup.

FIG. 2 also illustrates mounting tabs 28 at substantially opposite positions on the perimeter of potting cup 14. In the example illustrated in FIG. 2, each of mounting tabs 28 defines a hollow center. The hollow center may be threaded and configured to accept a screw, bolt or another mechanical securing mechanism in order to mount assembly 10 to a printed wiring board. In other examples, mounting tabs 28 may be configured to be soldered or adhered to a printed board in order to mechanically couple assembly 10 to a printed board. Assembly 10 may, in other examples, include more or fewer than two mounting tabs 28 at various positions around the perimeter of potting cup 14.

In some examples, mounting tabs 28 are thermally conductive and thermally coupled to potting cup 14. When mounted on a printed wiring board 10, mounting tabs 28 can be thermally connected to a thermal trace of the printed board, whereby the thermal trace is in thermal communication with a heat-dissipation portion (e.g., a layer) of the printed board. In this way, in some examples, mounting tabs 28 can be configured to help dissipate heat away from assembly 10 by thermally connect potting cup 14, as well as toroidal inductor 12 at least partially enclosed by potting cup 14, to a heat dissipation portion of the printed board.

In the example illustrated in FIG. 2, center portion 36 is visible within the center of void 19 of toroidal inductor 12. Center portion 36 is configured to extend at least partially through void 19 of toroidal inductor 12 (as shown in FIGS. 1 and 4) and is surrounded by potting material 16, which may substantially fill the space between toroidal inductor 12 and center portion 36. As illustrated in FIG.2, potting material 16 also substantially fills the space between toroidal inductor 12 and potting cup 14. As previously discussed, potting material 16 helps to increase the robustness and mechanical integrity of assembly 10 by integrating toroidal inductor 12 and potting cup 14 into a substantially unitary structure. In addition, the positioning of potting material 16 between otherwise empty spaces between toroidal inductor 12 and potting cup 14 can both help increase the conduction of heat away from toroidal inductor 12 and decrease the environmental contaminants that may be introduced into potting cup 14.

As previously described, a toroidal inductor can include any suitable number of conductive windings (e.g., one, two, three or more), any of which can define lead sets for electrically connecting to a printed board. In some examples, each conductive winding of a toroidal inductor terminates in a respective lead set. FIG. 3 illustrates a schematic top view of another example assembly 40, which includes toroidal transformer 42, potting cup 44, and potting material 16. Potting material 16 is introduced into potting cup 44 to fill the space between toroidal transformer 42 and potting cup 44. In contrast to toroidal inductor 12 of FIGS. 1 and 2, toroidal transformer 42 includes two conductive windings 48 and 50, which each terminate in a respective pair of leads 52A, 52B and 54A, 54B (collectively referred to as "lead set 52" and "lead set 54", respectively). Potting cup 44 is configured to accept lead sets 52 and 54 via a plurality of, e.g., four, apertures defined by potting cup 44. The apertures may be defined within potting cup 44 at positions around the perimeter of potting cup 44 that correspond to the positions of lead sets 52 and 54 of toroidal transformer 42.

In some examples, potting cup 44 is substantially the same as potting cup 14 (FIG. 1), and four knock-outs are selected to define respective apertures for the leads 52A, 52B and 54A, 54B. If potting cup 44 includes more than four predefined knock-outs, the knock-outs that are selected to define the apertures for leads 52A, 52B, 54A, 54B can be selected based on the configuration of the printed board to which toroidal transformer 42 is electrically coupled. For example, the printed board can include a specific arrangement of electrical contacts, and the knock-outs that provide the shortest path between lead sets 52, 54 and the respective electrical contacts for the leads can be selected to define the apertures through which lead sets 52, 54 extend out of potting cup 44.

FIG. 4 illustrates a schematic cross-sectional view of assembly 10 (FIGS. 1, 2) mounted to printed board 56, where the cross-section of assembly 10 is taken along, e.g., an x-z or y-z plane through a center of assembly 10. Mounting tabs 28 are not shown in FIG. 4. In the view shown in FIG. 4, the cross-section is taken substantially through a center of potting cup 14. As previously discussed, potting cup 14 can be mechanically coupled to printed board 56 using any suitable technique, such as an adhesive, welding, or mounting tabs 28 and an attachment member (e.g., a bolt or screw), an attachment element extending through a center of potting cup 14, or another mechanical mechanism. In the example shown in FIG. 4, adhesive 58 is positioned between bottom surface 32 (of potting cup 14) and printed board 56 in order to mechanically couple assembly 10 to printed board 56. Leads 22 of toroidal inductor 12 are electrically connected to conductive circuit traces 60 on printed board 56, e.g., via soldering, in order to electrically connect toroidal inductor 12 to printed board 56. In this way, toroidal inductor 12 may be electrically connected to other electronic circuit components that are electrically connected to printed board 56.

Adhesive 58 may be any adhesive suitable for mechanically coupling assembly 10 to printed board 56. For example, adhesive 58 may comprise an epoxy. As an example, adhesive 58 may be made from a material such as Scotch-Weld made commercially available by 3M Company of Maplewood, Minn., ME7159 Epoxy Paste Adhesive, made commercially available by AI Technology, Inc. of Princeton Junction, N.J., or Ther-O-Bond 1600 made commercially available by Aavid Thermalloy of Concord, N.H. In some examples adhesive 58 may comprise a material that is thermally conductive in order to distribute heat generated by toroidal inductor 12 over a relatively large surface area of the printed wiring board. In these examples, adhesive 58 may be formed from a material with particular thermal properties. For example, adhesive 58 may be formed from a material selected to have a particular thermal conductivity, e.g., between approximately 0.4 Watts/meter/Kelvin (e.g., Scotch-Weld) and approximately 10.4 Watts/meter/Kelvin (e.g., ME 7159). Adhesive 58 may, alternatively or additionally, be selected to have a particular coefficient of thermal expansion (CTE), e.g., between approximately 25 parts-per-million/degree Celsius (e.g., Ther-O-Bond 1600) and approximately 120 parts-per-million/degree Celsius (e.g., ME7159). Furthermore, in some examples, adhesive 58 can be electrically insulative.

Figure 5:
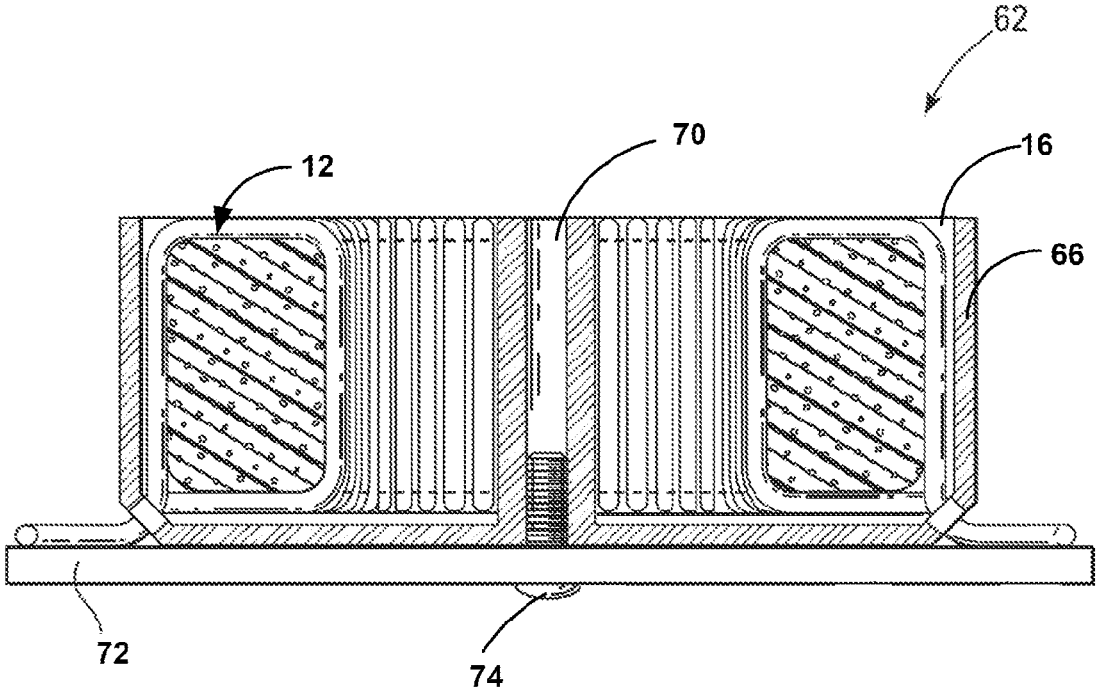
FIG. 5 is a schematic cross-sectional illustration of an example assembly including a self-leaded toroidal inductor, a potting cup that includes a threaded insert, and potting material.

FIG. 5 illustrates a schematic cross-sectional view of another example assembly 62 mounted to a printed board 72 taken through a center of the assembly in a direction substantially parallel to a center axis of inductor 12. Assembly 62 includes toroidal inductor 12, potting cup 66, and potting material 16. The cross-sectional view shown in FIG. 5 is taken along a plane that extends substantially through a center of toroidal inductor 12 and potting cup 66. Potting cup 66 may be substantially similar to potting cup 14 (FIGS. 1, 2, and 4). However, a center portion of potting cup 66 defines threaded insert 70 that can be used to mechanically connect potting cup 66 to printed board 72.

Threaded insert 70 is configured to accept attachment member 74 in order to mechanically couple assembly 62 to printed board 72. In the example shown in FIG. 5, attachment member 74 is a bolt or a screw. As illustrated in FIG. 5, attachment member 74 is inserted into threaded insert 70 and through printed board 72 in order to maintain printed board 72 proximate to potting cup 66. Mounting techniques such as with adhesive 58 (FIG. 4) and attachment member 74 may reduce the amount of mechanical strain on the leads of assembly 10 or assembly 62, respectively. Any suitable number of mounting techniques can be used in conjunction with each other.

Figure 6:
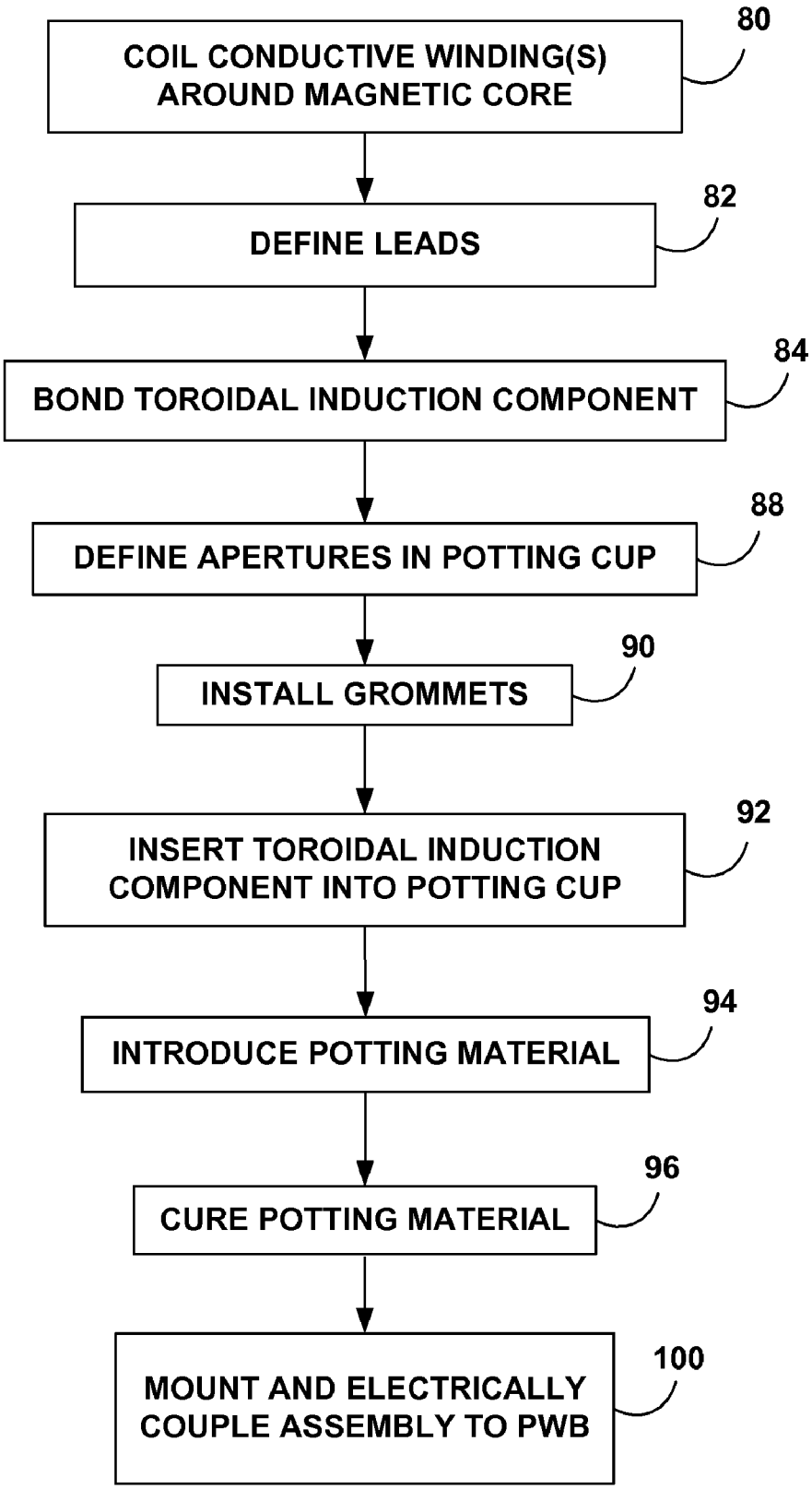
FIG. 6 is a flow diagram illustrating an example technique for forming an assembly that includes a self-leaded toroidal induction component with one or more lead sets, a potting cup configured to receive the one or more lead sets, and potting material.

FIG. 6 illustrates an example technique for forming an assembly, such as assembly 10 (FIGS. 1, 2, and 4), that includes a toroidal induction component, a potting cup, and potting material. While FIG. 6 is described with respect to assembly 10, in other examples, an assembly including another type of toroidal induction component, a potting cup, and potting material can be formed using the technique shown in FIG. 6. For example, an assembly including a toroidal induction component that includes a plurality of conductive windings that define respective lead sets can be formed using the technique shown in FIG. 6.

Toroidal induction component 12 may be formed using any suitable technique. In the example shown in FIG. 1, conductive windings 18 are coiled (e.g., wrapped) around torus-shaped magnetic core 20 (80). For example, conductive winding 18 can be coiled through void 19 defined by magnetic core 20, as illustrated in FIG. 1. Conductive winding 18 may be coiled such that the two ends of conductive winding 18 form a pair of leads 22. In addition, in some examples, the conductive wire defining conductive winding 18 is coiled such that its winding stop and start points are at a bottom periphery, such that lead set 22 can be defined near a bottom surface of toroidal induction component 12 (e.g., as shown in FIG. 1). In some examples, one or more other regions of conductive winding 18 (e.g., a region not at an end) can be used to electrically connect a lead to conductive winding 18. In some examples, an adhesive, e.g., an adhesive tape, may be wound around the perimeter of magnetic core 20 in order to hold conductive winding 18 substantially in place.

Lead set 22 is defined at the ends of conductive winding 18 by the same electrically conductive wire that defines the winding 18 (82). Lead set 22 may be defined using any suitable technique or equipment. The ends of conductive winding 18 are positioned to extend radially outward from a center of magnetic core 20, e.g., extend substantially perpendicularly outward from the outer perimeter of potting cup 14. In some examples, the ends of the conductive window 18 can also be positioned to bend in a different direction relative the first initial radially outward direction. Any suitable bend angle for wires 20 relative to a direction substantially perpendicular to a center axis (e.g., extending a substantially z-axis direction) of inductor 12 can be used, and may be selected based on the particular application for assembly. In some examples, the bend angle is about 30 degrees to about 120 degrees relative to the center axis of inductor 12, such as about 90 degrees, as shown in FIG. 2.

In some examples, a forming jig that defines the location and bend angle of lead set 22 can be implemented in order to more predictably define lead set 22. The forming jig can, for example, hold magnetic core 20 and conductive windings 18 in place and include an indicator (e.g., a visible marker or a mechanically formed guide) that indicates the position and bend angle of each of the leads 22A, 22B. The forming jig may be useful to substantially align the configuration of lead set 22 with aperture set 24 defined by potting cup 14, such that when inductor 12 is introduced into potting cup 14, lead set 22 is properly positioned to be threaded through the respective aperture 24.

The specific configuration of lead set 22 (e.g., the length of lead set 22, the direction in which lead set 22 extend from magnetic core 20, and the like) may be selected based on the configuration of the potting cup of the assembly. For example, in examples in which potting cup 14 includes an interface surface portion 34 (FIG. 1) that defines an angled surface between side surface 30 and bottom surface 32 of potting cup 14, lead set 22 may be formed at an angle that corresponds to the angle of interface surface portion 34 relative to side surface 30 and bottom surface 32 in order to facilitate placement of the leads within apertures defined by the interface portion. As an example, as illustrated in FIG. 4, potting cup 14 of assembly 10 includes interface surface 34 that defines a surface at an angle of approximately 45 degrees between side surface 30 and bottom surface 32 of potting cup 14. In this example, lead set 22 may be formed such that lead set 22 extends downward from the perimeter of the bottom surface of toroidal inductor 12 at an angle of approximately 45 degrees in order to facilitate placement of lead set 22 within aperture set 24 of potting cup 14.

In examples in which potting cup 14 does not include interface surface portion 34 from which lead set 22 extends, potting cup 14 may be a substantially cylindrical structure in which the outer perimeter of side surface 30 of the potting cup is directly connected to the outer perimeter of bottom surface 32 of potting cup 14. In these examples, aperture set 24 configured to accept lead set 22 may be defined by either side surface 30 and/or bottom surface 32 of potting cup 14. In examples in which aperture set 24 is defined by bottom surface 32 of potting cup 14, for example, lead set 22 may be configured to extend from a bottom surface of toroidal induction component 12 in a direction substantially directly downward (e.g., in a negative z-axis direction), e.g., at an angle of approximately 90 degrees from the plane of the bottom surface of the toroidal induction component, in order to facilitate placement of lead set 22 within apertures defined through bottom surface 32 of potting cup 14.

Before or after the configuration of lead set 22 relative to a center axis (CA in FIG. 2, which runs substantially along the z-axis direction) of magnetic core 20 is established, the ends of conductive winding 18 can be stripped and trimmed to the length desirable for lead set 22, e.g., the minimum length necessary to extend through aperture set 24 of potting cup 14 and reach a surface of a printed board to which the lead set 22 is electrically coupled.

Toroidal induction component 12 may be bonded to magnetic core 20 using any suitable technique, e.g., vacuum impregnation (84). For example, a resin can be used to mechanically bond conductive winding 18 to magnetic core 20 of toroidal inductor 12. Additionally or alternatively, the resin may fill pores within magnetic core 20. The resin or other bonding material can be a relatively low-viscosity material that hardens after, e.g., a particular amount of time or under a particular environmental condition (e.g., a high temperature), and creates a permanent or semi-permanent mechanical bond between conductive windings 18 and magnetic core 20 to form a substantially uniform structure and to maintain lead set 22 in a desired configuration relative to magnetic core 20 and the winding path defined by conductive winding 18.

In some examples, the technique shown in FIG. 6 includes forming potting cup 14. Potting cup 14 may be formed using any suitable technique. For example, potting cup 14 may be molded from a plastic or may be formed from a metal. The potting cup may be formed to include any of a center portion (e.g., center portion 36), a threaded insert (e.g., threaded insert 70), one or more mounting tabs (e.g., mounting tabs 28), or any other feature that may be suitable for increasing thermal performance of the assembly, increasing mechanical stability of the assembly, or facilitating mounting of the assembly to a printed wiring board.

Potting cup 14 may also be formed such that potting cup 14 comprises knock-outs that can be selectively removed to define aperture set 24 that is configured to receive lead set 22 defined by conductive winding 18 of toroidal induction component 12. For example, a frangible seam can be defined in interface surface 34 of potting cup 14 at each of predefined locations for an aperture, though the aperture need not actually be defined until the material surrounded by the frangible seam is removed from potting cup 14. The frangible seam can be defined, e.g., by reducing a thickness of the material of potting cup 14 or perforating potting cup 14 to define the outline of an aperture 14, such that a predefined portion of potting cup 14 is prone to breaking more easily than surrounding portions. In other examples, a plurality of apertures may initially be defined by potting cup 14 and apertures may be selectively plugged in order to define aperture set 24 that includes specific apertures configured to accept leads 22A and 22B, e.g., all apertures other than apertures 24A, 24B may be plugged. Alternatively or additionally, aperture set 24 may be defined by another technique, e.g., by drilling through the wall of potting cup 14.

The number and position of aperture set 24 defined in potting cup 14 can be selected based on the number and position of the leads of toroidal induction component 12. For example, in examples in which toroidal induction component 12 comprises one conductive winding 18 and, consequently, one lead set 22, potting cup 14 may require one aperture set 24, e.g., as illustrated in FIG. 1. Thus, two knock-outs may selectively be removed from potting cup 14 to accommodate the two leads of lead set 22. The position of apertures 24A, 24B of aperture set 24 may be selected based on the position of each of leads 22A, 22B of lead set 22 relative to the outer perimeter of toroidal induction component 12. For example, in examples in which leads 22A, 22B extend from substantially opposite sides of an outer perimeter of toroidal induction component 12, e.g., as illustrated in FIG. 2, apertures 24A, 24B may be formed on substantially opposite sides of potting cup 14, e.g., positions corresponding to the positions of the leads.

In some examples, grommets 26A, 26B, respectively, or another type of sleeve, may be introduced within respective apertures 24A, 24B in order to seal the interface between lead set 22 and potting cup 14 (90). As discussed above, grommets 26A, 26B each occupy a space between leads 24A, 24B, respectively, and potting cup 14, thereby helping to prevent moisture and corrosive agents from leaking into potting cup 14. In addition, when potting material 16 is introduced into potting cup 14, grommet set 26 can help prevent potting material 16 from leaking out of potting cup 14 before potting material 16 has been cured or otherwise set.

Toroidal induction component 12 is inserted into potting cup 14 (92). During this stage, lead set 22 defined by conductive winding 18 of toroidal induction component 12 are guided into aperture set 24 defined by potting cup 14 and introduced through the apertures such that lead set 22 protrudes from an outer surface of potting cup 14. In examples in which potting cup 14 includes, e.g., a center portion or a threaded insert, toroidal induction component 14 is introduced into potting cup 14 such that the center portion or the threaded insert is within void 19 defined by toroidal induction component 12.

After toroidal induction component 12 is positioned within potting cup 14, a potting material 16 can be introduced into potting cup 14 (94). Potting material 16 may be a relatively low-viscosity material that fills spaces within potting cup 14 that are not occupied by toroidal induction component 12. Potting material 16 can be cured and hardened after it is introduced into potting cup (96). For example, potting material 16 can be cured by applying a UV light, although other types of potting materials are contemplated. After curing and hardening of potting material 16, an assembly that includes toroidal induction component 12, potting material 16, and potting cup 14 is defined. In some examples, potting material 16 comprises a thermally conductive material that may, in combination with a thermally conductive potting cup, increase the thermal performance of the toroidal induction component by improving heat transfer away from toroidal induction component 12.

After insertion into the potting cup, lead set 22 of toroidal induction component 12 can be prepared for electrical connection to a printed wiring board. For example, if assembly 10 is mounted to a printed wiring board via surface mount technology or through-hole technology, leads 20 can be cut to a length that facilitates attachment of lead set 22 to a particular conductive trace on a surface of the printed wiring board. The leads may also be stripped of any excess material, e.g., potting material, that may be in contact with the exposed electrically conductive portions of lead set 22. In some examples, lead set 22 can be bent at a particular angle, e.g., at an angle of approximately 90 degrees as illustrated in FIG. 2, relative to a center axis of toroidal induction component 12.

In the technique shown in FIG. 6, lead set 20 is electrically coupled to a printed wiring board via any suitable technique, e.g., soldering or wire bonding, and assembly 10 is mounted and secured to the printed wiring board (100). Potting cup 14 that predefines aperture set 24 through which lead set 22 extends can help minimize the amount of time that is required to electrically couple inductor 12 to the printed wiring board. For example, as discussed above, aperture set 24 in potting cup 14 can be selected to be in a location that aligns lead set 22 with respective conductive pads on the printed wiring board. In this way, time spent by an operator aligning lead set 22 with respective conductive pads on the printed wiring board can be minimized compared to inductor assemblies that include a loose lead set 22 that do not have any particular, predefined configuration relative to a center axis of the inductor.

Assembly 10 is mounted and secured to the printed wiring board using any suitable technique. In some examples, an adhesive can be positioned between the bottom surface of potting cup 14 and the printed wiring board (e.g., as shown in FIG. 4) to enhance mechanical stability of the position of assembly 10 relative to the printed wiring board. Alternatively or additionally, potting cup 14 may comprise a threaded insert (e.g., as shown in FIG. 5) that is configured to accept an attachment member, e.g., a bolt or a screw, for mounting of the assembly to a printed wiring board. Alternatively or additionally, the potting cup or another component of the assembly may comprise mounting tabs that facilitate mounting of the assembly to a printed wiring board via, e.g., soldering or bolt-mounting.

Various examples have been described. These and other examples are within the scope of the following claims.

The invention claimed is:

1. An assembly comprising:

a toroidal induction component that comprises:

at least one conductive winding, wherein ends of the at least one conductive winding define a lead set comprising a first lead and a second lead; and a magnetic core;

a potting cup that defines at least one aperture set comprising at least a first aperture that is configured to receive the first lead and a second aperture that is configured to receive the second lead;

a grommet positioned within the first aperture, wherein the grommet defines a seal between the first lead and the first aperture; and a potting material within the potting cup.

2. The assembly of claim 1, wherein the first lead and the second lead are located proximate to a periphery of a bottom surface of the toroidal induction component.

3. The assembly of claim 1, wherein the toroidal induction component defines a void, and the potting cup comprises a center portion that is configured to extend substantially entirely through the void defined by the toroidal induction component.

4. The assembly of claim 1, further comprising a printed board, wherein the potting cup is configured to be mounted to the printed board and the lead set is configured to be electrically connected to an electrically conductive trace set of the printed board.

5. The assembly of claim 4, wherein the potting cup is configured to be mechanically mounted to the printed board via at least one of a bolt, an adhesive, one or more mounting tabs, or one or more solder tabs.

6. The assembly of claim 4, wherein the printed board comprises a thermally conductive portion and the potting cup is configured to be thermally connected to the thermally conductive portion by at least one thermally conductive via.

7. The assembly of claim 1, wherein the toroidal induction component defines a void, and wherein the potting cup comprises a threaded insert configured to extend at least partially through the void of the toroidal induction component, wherein the threaded insert is configured to receive at least one of a screw or a bolt.

8. The assembly of claim 1, wherein the potting material comprises at least one of a thermosetting resin or an epoxy.

9. The assembly of claim 1, wherein the potting material comprises an electrically non-conductive, thermally conductive material.

10. The assembly of claim 1, wherein the potting cup comprises a thermally conductive material.

11. The assembly of claim 1, wherein the potting cup defines a plurality of knock-outs that are more easily removed from the potting cup than other portions of the potting cup, wherein the first and second apertures are each defined by selective removal of respective knock-outs.

12. The assembly of claim 1, wherein the potting material substantially fills a space within the potting cup that is not occupied by the toroidal induction component.

13. The assembly of claim 1, wherein the grommet comprises an electrically insulating material.

14. A method comprising:

defining at least one aperture set in a potting cup, wherein the at least one aperture set comprises a first aperture and a second aperture;

inserting a toroidal induction component into the potting cup, wherein the toroidal induction component comprises at least one conductive winding around a magnetic core and at least a first lead and a second lead defined by respective ends of the at least one conductive winding, and wherein inserting the toroidal induction component into the potting cup comprises inserting the first lead into the first aperture and the second lead into the second aperture;

introducing a grommet into at least one of the first aperture or the second aperture of the at least one aperture set defined in the potting cup, wherein the grommet defines a seal between the at least one of the first aperture or the second aperture and the respective one of the first and second leads; and introducing a potting material into the potting cup.

15. The method of claim 14, further comprising forming the toroidal induction component by at least:

coiling the at least one conductive winding around the magnetic core; and defining the lead set at ends of the at least one conductive winding.

16. The method of claim 14, further comprising curing the potting material.

17. The method of claim 11, further comprising mounting an assembly comprising the toroidal induction component, the potting cup, and the potting material to a printed board.

18. The method of claim 14, wherein the potting material comprises at least one of an electrically non-conductive, thermally conductive material or a thermally conductive material.

19. The method of claim 14, wherein defining at least one aperture set in the potting cup comprises selectively removing at least two predefined knock-outs from the potting cup.

20. An assembly comprising:

a toroidal induction component that comprises an electrically conductive wire;

at least one lead set defined by ends of the electrically conductive wire;

a potting cup configured to receive the toroidal induction component, wherein leads of the lead set each extend through a respective aperture defined by the potting cup; and a printed board, wherein the potting cup is configured to be mounted to the printed board and the leads of the lead set are configured to be surface mounted or through-hole mounted to the printed board.

* * * * *